United States Patent [19]

Saito

[11] 4,270,992

[45] Jun. 2, 1981

[54] PROCESS FOR PRODUCING GLYCOL

[75] Inventor: Mitsutaka Saito, Tokuyama, Japan

[73] Assignee: Toyo Soda Manufacturing Co., Ltd., Shin-nanyo, Japan

[21] Appl. No.: 147,959

[22] Filed: May 8, 1980

[30] Foreign Application Priority Data

Jun. 1, 1979 [JP] Japan ..... 52/67511

[51] Int. Cl.[3] ..... C25B 3/10

[52] U.S. Cl. ..... 204/59 R; 204/72

[58] Field of Search ..... 204/59 R, 72, 77

[56] References Cited

U.S. PATENT DOCUMENTS 3,899,401 8/1975 Nohe et al. ..... 204/59 R

*Primary Examiner*—Howard S. Williams

*Attorney, Agent, or Firm*—Oblon, Fisher, Spivak, McClelland & Maier

[57] ABSTRACT

Ethyleneglycol or a mixture of ethyleneglycol and propyleneglycol is produced by an electrolysis of formaldehyde in an alkaline solution by using a carbon type electrode as a cathode.

4 Claims, No Drawings

PROCESS FOR PRODUCING GLYCOL

BACKGROUND OF THE INVENTION

1. Field of the Invention

The present invention relates to a process for producing a glycol from formaldehyde. More particularly, it relates to a process for producing a glycol such as ethyleneglycol and propyleneglycol by an electrolytic coupling of formaldehyde.

2. Description of the Prior Arts

Various coupling reactions have been known in the organoelectrolyses. It has been well known to produce pinacol from acetone or to produce adiponitrile by a hydrodimerization of acrylonitrile. Most of such coupling reactions are reductive-couplings of an acrylic acid derivative, or an aliphatic or aromatic ketone on a cathode. An electrolytic coupling of an aliphatic aldehyde has not been substantially employed.

SUMMARY OF THE INVENTION

It is an object of the present invention to provide a process for producing a glycol such as ethyleneglycol and propyleneglycol by a simple manner in high efficiency and high yield.

The foregoing and other objects of the present invention have been attained by producing a glycol by an electrolysis of formaldehyde in an alkaline solution with a carbon type electrode as a cathode.

DETAILED DESCRIPTION OF THE PREFERRED EMBODIMENTS

The inventors have found that ethyleneglycol is produced in high yield by an electrolysis of formaldehyde in an alkaline solution with a carbon type electrode as a cathode and propyleneglycol is also produced when a potassium salt is used as a base.

In accordance with the process of the present invention, it is enough to electrolyze it by placing a cathode and an anode in the electrolytic solution, but it is not necessary to partition the cathode and the anode with a diaphragm etc.

The electrolytic solution is preferably an aqueous solution of formaldehyde or a solution of formaldehyde in an alcohol such as methanol or ethanol in which a small amount of an electrolyte for example, an alkali metal hydroxide such as sodium or potassium hydroxide, an alkali metal phosphate such as trisodium phosphate, sodium hydrogenphosphate and dipotassium hydrogenphosphate; and an alkali metal carbonate or bicarbonate such as sodium, potassium and lithium carbonates and sodium bicarbonate; and ammonia, is incorporated. The reaction is effectively performed in an alkaline solution having pH of higher than 8.

In an acidic solution, ethyleneglycol is not substantially produced but a polymerized formaldehyde such as paraformaldehyde is produced. When a potassium salt is used as an electrolyte, propyleneglycol is also produced.

Only when a carbon electrode is used as the cathode, a desired result have been attained. The carbon electrode is preferably of a graphite having a graphitization as represented by a bulk density ranging from 1.5 to 1.75 g/cm$^3$, an average lamella thickness ranging from 250 to 1000 Å and a specific resistance ranging from $5\times10^{-4}$ to $11\times10^{-4}$ Ω.cm. The anode can be made of a substrate which is anticorrosive to the electrolyte such as platinum, lead, silver and carbon type substrate. It is preferable to use the carbon type electrode for both the anode and the cathode. A concentration of the electrolyte in the electrolytic solution can be in a range of 0.1% to a saturated concentration preferably 1 to 20%. It is preferable to have pH of higher than 8 in the case of the aqueous solution.

Formaldehyde used in the present invention can be formalin as 37% aqueous solution of formaldehyde, paraformaldehyde and trioxane. It is possible to feed a synthesis gas including formaldehyde into the reaction system to absorb and to react it. A concentration of formaldehyde is not critical and is preferably in a range of 2 to 60 wt.% especially 20 to 50 wt.%.

A temperature in the electrolysis is in a range of the ambient temperature to 100° C. A current density is not critical and is preferably in a range of 0.1 to 20 A/dm$^2$. A solvent can be water, a lower alcohol such as methanol and ethanol; a diol such as ethyleneglycol. The glycol is produced at high selectivity to glycols in the process of the present invention. Only small amount of methanol is produced beside the production of glycols. Therefore, a purification of the product by a separation is easily attained.

The present invention will be further illustrated by certain examples and references which are provided for purposes of illustration only and are not intended to be limiting the present invention.

EXAMPLE 1

Into 200 ml. of formalin (commercial product: 37% of formaldehyde), 2 g. of potassium hydroxide was dissolved. Two graphite electrode, each one of which had a size of 15 mm×30 mm, a bulk density of 1.70 g/cm$^3$, an average lamella thickness of 700 Å and a specific resistance of $6.5\times10^{-4}$ Ω. cm, were placed in the solution with a distance of the electrodes of 6 mm. An electrolysis was carried out under a constant current of 0.5 A and a cell voltage of 6 V at a reaction temperature of 50° C. After the electrolysis, the reaction mixture was analyzed by a gas-chromatography to find the fact that ethyleneglycol was produced at a rate of 0.93 g/A.hr. and propyleneglycol was produced at a rate of 0.08 g/A.hr. No other product was found beside the compounds contained the formalin. A theoretical yield of ethyleneglycol is 1.16 g/A.hr. and accordingly a current efficiency was 80%.

The same electrolysis was repeated except substituting the electrodes to platinum plates or lead plates containing 0.8 wt.% of silver. As a result, the product was substantially methanol. Ethyleneglycol was not found even as a trace.

EXAMPLE 2

In accordance with the process of Example 1 except using 2 g. of sodium hydroxide instead of potassium hydroxide, the electrolysis was carried out. As a result, only trace of propyleneglycol was found and ethyleneglycol was produced at a rate of 0.94 g/A.hr.

EXAMPLE 3

In accordance with the process of Example 1 except using 2 g. of sodium hydrogen carbonate instead of potassium hydroxide and reacting at 55° C. for 8 hours at a cell voltage of 7.0 V, the electrolysis was carried out. As a result, only ethyleneglycol was produced at a rate of 0.82 g./A.hr.

EXAMPLE 4

In accordance with the process of Example 1 except using 2 g. of potassium carbonate instead of potassium hydroxide and reacting at 48° C. for 8 hours at a cell voltage of 5 V, the electrolysis was carried out. As a result, ethyleneglycol was produced at a rate of 0.64 g./A.hr. and propyleneglycol was produced at a rate of 0.11 g./A.hr.

EXAMPLE 5

In accordance with the process of Example 1 the electrolysis was carried out by using a solution containing 10 g. of paraformaldehyde, 20 ml. of methanol and 2 g. of sodium hydroxide at 66° C. for 8 hours at a cell voltage of 10 V. As a result, ethyleneglycol was produced at a rate of 0.16 g./A.hr.

REFERENCE 1

In accordance with the process of Example 1, the electrolysis was carried out by using a mixture of 20 ml. of formalin and 2 ml. of phosphoric acid for 8 hours. No ethyleneglycol was produced but polymerized formaldehyde as paraformaldehyde was precipitated.

I claim:

1. In a process for producing a glycol from formaldehyde, an improvement characterized in that the electrolysis of formaldehyde is carried out in an alkaline solution by using a carbon type electrode as a cathode.

2. The process for producing a glycol according to claim 1 wherein an alkali metal hydroxide, an alkali metal carbonate, an alkali metal phosphate or ammonia is used as an electrolyte.

3. The process for producing a glycol according to claim 2, wherein ethyleneglycol and propyleneglycol are produced by using potassium hydroxide or a potassium salt as the electrolyte.

4. The process for producing a glycol according to claim 2 wherein ethyleneglycol is produced by using sodium hydroxide or a sodium salt as the electrolyte.

* * * * *